United States Patent [19]

Fuzishita et al.

[11] Patent Number: 4,916,311

[45] Date of Patent: Apr. 10, 1990

[54] ION BEAMING IRRADIATING APPARATUS INCLUDING ION NEUTRALIZER

[75] Inventors: Naomitsu Fuzishita; Shigeo Sasaki; Yasushi Matsumura; Akira Shuhara; Kazuhiro Shono, all of Hyogo, Japan

[73] Assignee: Mitsubishi Denki Kabushiki Kaisha, Tokyo, Japan

[21] Appl. No.: 166,074

[22] Filed: Mar. 9, 1988

[30] Foreign Application Priority Data

| | | | |
|---|---|---|---|
| Mar. 12, 1987 | [JP] | Japan | 62-55303 |
| Mar. 18, 1987 | [JP] | Japan | 62-64861 |
| Mar. 18, 1987 | [JP] | Japan | 62-64863 |
| Jul. 20, 1987 | [JP] | Japan | 62-180298 |

[51] Int. Cl.[4] ..... H05H 3/00

[52] U.S. Cl. ..... 250/251; 250/492.2; 250/398

[58] Field of Search ..... 250/251, 398, 492.21, 250/492.2

[56] References Cited

U.S. PATENT DOCUMENTS

| | | | |
|---|---|---|---|
| 4,120,700 | 10/1978 | Morimoto | 148/1.5 |
| 4,135,097 | 1/1979 | Forneris et al. | 250/306 |
| 4,361,761 | 11/1982 | Treglio | 250/251 |
| 4,361,762 | 11/1982 | Douglas | 250/251 |

FOREIGN PATENT DOCUMENTS

| | | |
|---|---|---|
| 57-75463 | 5/1982 | Japan . |
| 57-87056 | 5/1982 | Japan . |
| 58-75463 | 5/1983 | Japan . |
| 59-20431 | 11/1984 | Japan . |
| 60-133757 | 7/1985 | Japan . |

*Primary Examiner*—Jack I. Berman

*Attorney, Agent, or Firm*—Lowe, Price, LeBlanc, Becker & Shur

[57] ABSTRACT

In an ion beam irradiating apparatus for providing a neutralized ion beam to a sample, there are provided an ion source, an accelerating device and an ion beam selecting device to which the accelerated and selection ion beam is irradiated. This irradiating apparatus further includes an ion neutralizer positioned between the selecting device and the sample, and includes: an electron beam emitting source for emitting an electron beam; a first electron scatter preventing electrode for preventing the electron beam emitted from the electron beam emitting source from being scattered outside the ion neutralizer; a second electron scatter preventing electrode for preventing the electron beam induced into the specified ion beam from being scattered in a direction opposite to an ion irradiating direction; and a control electrode for controlling a traveling velocity of the electron beam emitted from the electron emitting source so as to drift the emitted electron beam toward the sample, thereby neutralizing the selected ion beam at a location adjacent to a surface of the sample that is being irradiated.

5 Claims, 13 Drawing Sheets

ION BEAMING IRRADIATING APPARATUS INCLUDING ION NEUTRALIZER

BACKGROUND OF THE INVENTION

1. Field of the Invention

The present invention generally relates to an ion beam irradiating apparatus and, more particularly, to an ion beam irradiating apparatus including an ion neutralizer suitable for neutralizing electric charges present on a sample surface, for instance, a surface of a semiconductor substrate having an electric insulating structure.

2. Description of the Related Art

Various types of ion beam neutralizers have been proposed for use in an ion beam irradiating apparatus. Two typical types of conventional ion neutralizers are shown in the illustrations of FIGS. 1A and 1B.

In these illustrations, an electron shower (neutralizer) 1 comprises: a cup-shaped main body 2; a dot-shaped filament 3 provided in the main body 2; and a grating type drawing electrode 4 disposed in an opening section of the mainbody 2. Reference numeral 5 denotes an ion beam, reference numeral 6 is an electron beam, and reference numeral 7 is a sample to be irradiated.

The operation of the typical ion neutralizers will now be described. In the conventional neutralizer shown in FIG. 1A, the electron shower 1 electrically draws the electron beams 6 from the filament 3 at an accelerating voltage of approximately 100V by way of the drawing electrode 4. The electron beams 6 are emitted into a space through which the ion beam 5 passes, and the negative electric charges of the electrons are given to the ion beam 5, thereby neutralizing the same. Alternatively, in the conventional neutralizer shown in FIG. 1B, the electron beams 6 are directly irradiated onto the surface of the sample 7, thereby preventing accumulation of an electric charge in the sample 7 due to irradiating of the ion beam 5 onto the sample 7.

In recent years, an ion beam irradiating technique, for example in using an ion implanting apparatus of a semiconductor, has been put into practical use as a technique to dope impurities into an integrated circuit.

However, when $As^+$ ions were implanted by a large current into an integrated circuit, e.g., a 1 Mbit DRAM (dynamic random access memory) having a high packaging density, line widths thereof or a thickness of insulating layer of the submicron order, the potentials of the insulating layer in the integrated circuit and of the exposed semiconductor layer or conductive layer surrounded by the insulating layer attain high values due to accumulation of the positive electric charges (hereinafter, referred to as a "positive charging") carried thereto by the incident ion beam. As a result, the subsequent ion beam is deflected and the ions are not uniformly implanted. In the worst case, an electrical insulation breakdown may occur, so that the integrated circuit becomes inoperative. Thus, even if a large current type ion implanting apparatus is used to improve the throughput, an ion current value must be limited to a value such that a typical positive charging phenomenon does not occur in the integrated circuit. A serious practical problem therefore still remains.

To solve this problem, there has been proposed a method whereby the ion implantation is executed after a conductive material was coated onto the surface of an integrated circuit. This conventional method is disclosed in detail in, e.g., JP-A-57-75463, JP-A-58-75463, and JP-A-60-133757 (KOKAI). However, according to these conventional methods, processes to coat the conductive material and to thereafter eliminate it are needed before and after the ion implanting steps. Thus, there are drawbacks such that the whole process to manufacture an integrated circuit become complicated, and accordingly, the yield and throughput deteriorate.

Therefore, as a method of preventing the positive charging on the integrated circuit surface, attention is focussed on a method whereby electrons are supplied into an ion beam or onto the surface of an integrated circuit (hereinafter, simply referred to as a "sample") and the ion beam is thus neutralized.

As a conventional method of neutralizing the ion beam by use of electrons, a method whereby the positive charging is prevented by directly implanting electrons into a sample (e.g., per to JP-A-59-204231) is known. However, according to this prior art method, since an electron beam is also irradiated onto the sample surface on which no ion beam is irradiated, there is another problem such that the negative charging occurs in this region by the electrons and an insulation breakdown occurs in the sample.

On the other hand, in JP-A-57-87056 (corresponding to U.S. patent application Ser. No. 190,297, filed on Sept. 24, 1980), there is disclosed a method whereby the primary electrons are accelerated and drawn and irradiated onto a dummy target and an ion beam is neutralized by the secondary electrons generated from the dummy target. According to this method, there is an one result is that in the energy distribution of the secondary electrons which are emitted from the dummy target, secondary electrons of a low energy of about 10 eV are used. However, this method still has practical problems, such that a sample is adversely influenced by the reflected electrons having the same energy (hundreds of electron volts) as that of the primary electrons, that an amount of secondary electrons which are emitted changes remarkably in dependence on the surface condition of the dummy target, and the like.

Further, the foregoing conventional ion beam neutralizer has the following problems. Namely, a drawing voltage of approximately 100 V is needed to draw an amount of electrons necessary to neutralize the positive electric charges of an ion beam. However, since the electrons have the energy corresponding to the drawing voltage, the electrons are irradiated independently of the ion beam. Therefore, the electron current needs to be controlled in accordance with the ion beam. On the other hand, since the electron beam is similarly irradiated onto the surface of the sample to which no ion beam is irradiated, a corresponding negative charging is caused by the electrons. Consequently, there is a problem in that, for example the insulating structure of the sample is broken.

In addition, in the foregoing conventional ion beam irradiating apparatus, the emission coefficient of the secondary electrons from a sample varies, depending upon the sorts of ion and sample and the like. Consequently, there are problems, e.g., the moving energy of the electrons needs to be controlled in accordance with the variation in the emission coefficient, the control becomes complicated, and the like.

Further, there is also a problem that the electrons once injected into the ion beam are returned to the electron-beam emitting source because of the kinetic energy of the electrons themselves. On the other hand, since these electrons do not have the initial velocity component in the irradiating direction of the ion beam, a high energy is applied thereto in order to move the electrons toward the sample. Thus, there is also a danger that the electrons will collide with the sample and break it down.

SUMMARY OF THE INVENTION

The present invention has been made to solve the foregoing problems, and has therefore a main object of the invention to provide an ion beam irradiating apparatus which can easily neutralize the electric charges in the surface region of the sample.

The second object of the invention is to provide an ion beam irradiating apparatus in which even if density distribution, shape, and current amount of an ion beam will vary, the surface of the sample can be continuously neutralized and the adverse effect on the negative charging by electrons can be reduced.

The third object of the invention is to provide an ion beam irradiating apparatus which can minimize an emission amount of secondary electrons from a sample irrespective of the kinds of ion and sample.

The fourth object of the invention is to provide an ion beam irradiating apparatus which can supply electrons into an ion beam with higher efficiency and can easily deflect the electrons toward a sample.

These objects of the invention may be accomplished by providing an ion beam irradiating apparatus comprising:

generating means for generating ion beams;

accelerating means for accelerating the ion beams produced from the generating means;

selecting means for selecting a specified ion beam from the accelerated ion beams and;

ion neutralizer means positioned between the selecting means and the sample, and including an electron beam emitting source for emitting an electron beam, first electron scatter preventing means for preventing the electron beam emitted from the electron beam emitting source from being scattered outside the ion neutralizer means, second electron scatter preventing means for preventing the electron beam induced into the specified ion beam from being scattered in a direction opposite to an ion irradiating direction, and control means for controlling a traveling velocity of the electron beam emitted from the electron emitting source so as to drift the emitted electron beam toward the sample, thereby neutralizing the specified ion beam located adjacent to an irradiating surface of the sample.

BRIEF DESCRIPTION OF THE DRAWINGS

For a better understanding of the invention, reference is made to the following description in conjunction with the drawings, in which.

DETAILED DESCRIPTION OF THE PREFERRED EMBODIMENTS ION NEUTRALIZER OPERATED IN FIRST MODE

Figure 1A:
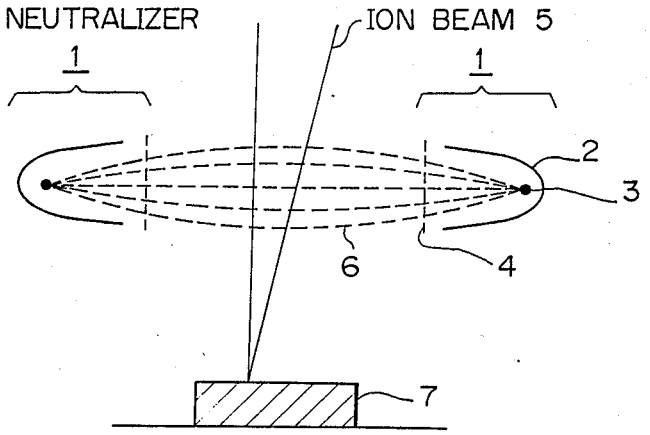
FIG. 1 A PRIOR ART
FIGS. 1A and 1B schematically illustrate a basic idea of the prior art ion beam irradiating apparatus.
Figure 1B:
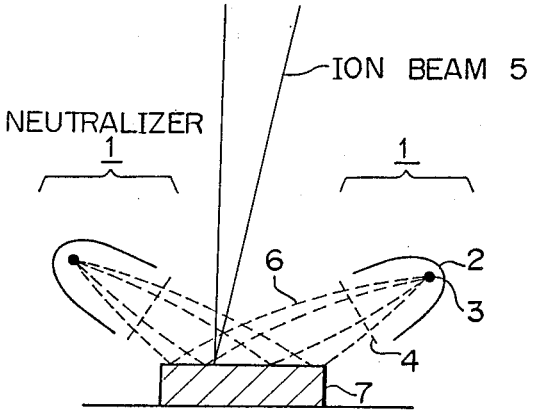
FIG. 1 B PRIOR ART
Figure 2:
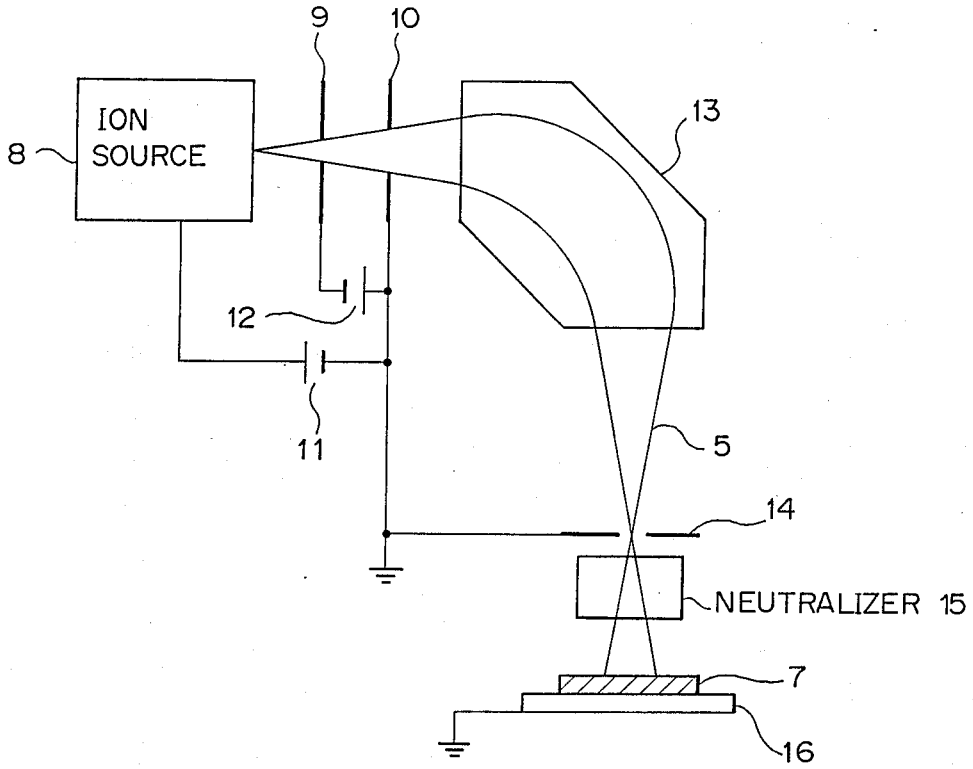
FIG. 2 is a schematic block diagram of an ion beam irradiating apparatus embodying an ion neutralizer according to a first preferred embodiment of this invention.
Figure 3:
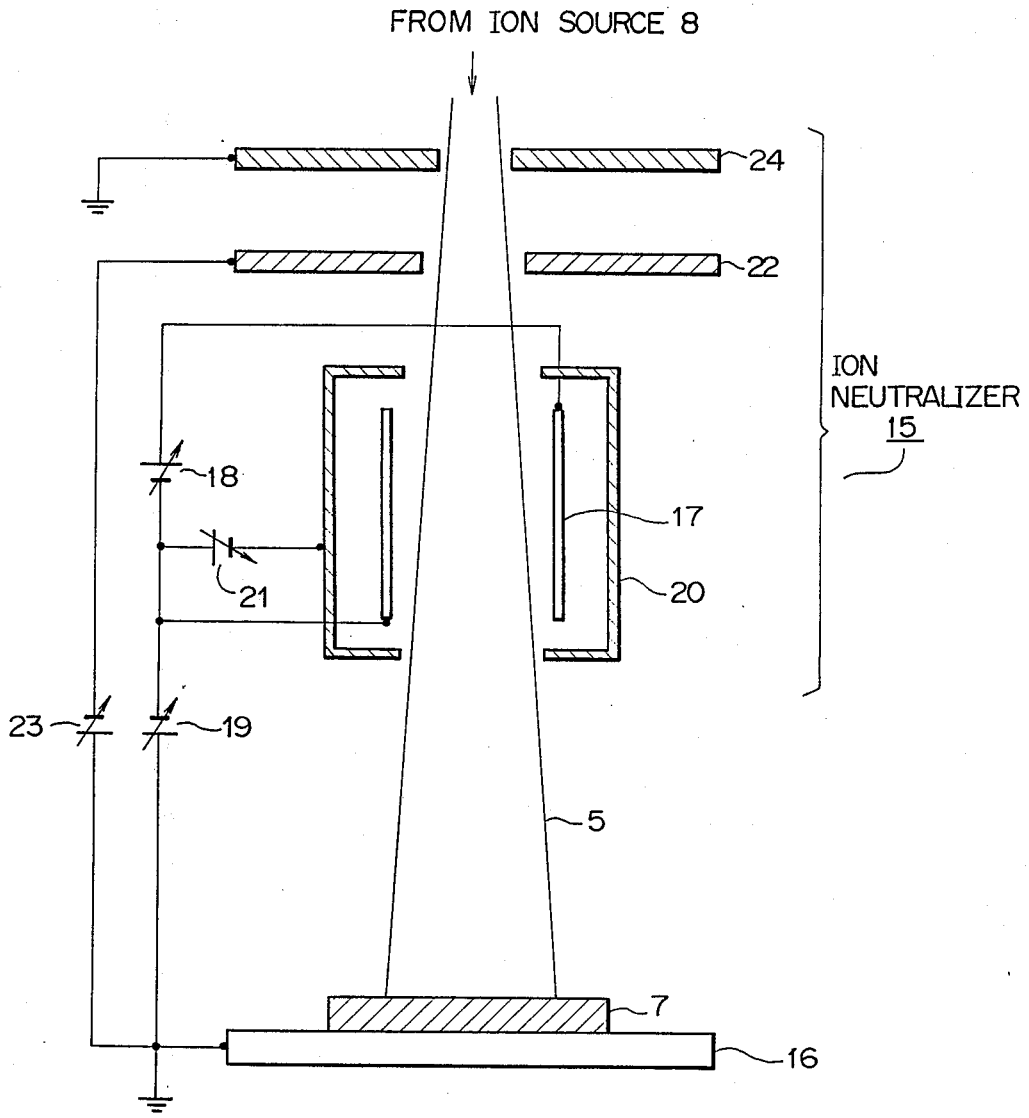
FIG. 3 is a detailed arrangement of the ion neutralizer shown in FIG. 2.

Referring now to FIGS. 2 and 3, an ion beam irradiating apparatus employing an ion beam neutralizer according to a first preferred embodiment will be described.

FIG. 2 is a block diagram showing an ion beam irradiating apparatus. An ion beam neutralizer 15 shown in FIG. 3 is employed in this irradiating apparatus.

A construction of the ion beam irradiating apparatus will be first explained. An ion beam of a large current is generated from an ion source 8. An ion beam drawing electrode 9 is maintained at a preselected negative potential so that an electron beam is not returned to the ion source 8 by a decelerating power supply 12. The ion beam 5 is drawn from the ion source 8 by an accelerating power supply 11. A decelerating electrode 10 is maintained at a ground potential. Reference numeral 13 denotes a mass separator; 14 indicates an aperture for allowing only specified ion species which were mass-separated to pass through; 15 represents an ion neutralizer to neutralize the electrical charges of ions provided to the surface region of the sample 7; and 16 is a sample holder.

FIG. 3 is a diagram showing a construction of the ion neutralizer 15 according to the preferred embodiment. A filament 17 is used as a source to emit thermoelectrons to the ion beam 5. A first power supply 18 heats the filament 17, thereby enabling thermoelectrons to be emitted therefrom. A second power supply 19 applies a negative potential to the filament 17 and serves as control means for drifting the thermoelectrons emitted from the filament 17 toward the sample 7 for thereby neutralizing the ions in the surface region of the sample 7. A thermoelectron shielding electrode 20 is provided to prevent the thermoelectrons emitted from the filament 17 from being scattered. A negative potential is applied to the electrode 20 from a third power supply 21. A shielding electrode 22 is provided to prevent the electrons from being returned in the ion beam to the ion source. A negative potential is applied to the electrode 22 from a fourth power supply 23. A neutralizer aperture 24 is used to prevent the ion beam from colliding with the interior of the neutralizer 15.

OPERATION OF ION BEAM IRRADIATING APPARATUS

The operation of the ion beam irradiating apparatus having the neutralizer 15 in the preferred embodiment will now be described with reference to FIGS. 2 and 3.

In the ion beam irradiating apparatus of FIG. 2, the ion beam 5, drawn from the ion source 8 via the electrode 10 by the accelerating power supply 11 is mass-separated to separate out therefrom only the specified ion species by means of the mass separator 13 and aperture 14. The specified ion species is irradiated onto the sample 7 fixed to the sample holder 16 and thus, a desired ion beam process such as an ion implantation or the like can be performed. At this time, the following interaction occurs between the ion beam 5 and thermoelectrons. The ion beam 5 passes through the neutralizer 15 disposed at an arbitrary position (in FIG. 2, between the aperture 14 and the sample 7) between the mass separator 13 and the sample 7. Thermoelectrons are emitted from the filament 17 (see FIG. 3) arranged near the ion beam 5. The thermoelectrons emitted from the filament 17 by heating the filament 17 under the first power supply 18 for use in the neutralizer 15 in FIG. 3 float in the space surrounded by the thermoelectron shielding electrode 20 and shielding electrode 22 which are biased to negative potentials as compared with the potential of the filament 17.

The thermoelectron shielding electrode 20 functions as a first electron scatter preventing means for preventing the thermoelectrons emitted from the filament (thermoelectron emitting source) 17 from being scattered outside the neutralizer 15. On the other hand, the shielding electrode 22 functions as a second electron scatter preventing means for preventing the thermoelectrons which were drawn onto an orbit of the ion beam 5 and taken into the ion beam 5 from being scattered in the direction opposite to the irradiating direction of the ion beam. When the ion beam 5 having a high positive potential passes in the space surrounded by both electrodes 20 and 22 in this state, electrons in an amount corresponding to the electron capture crosssectional area of the ion beam 5 are taken into the volume of the ion beam 5 until the potentials of the ion beam 5 and thermoelectrons are almost equalized to each other. Thus, the ion beam 5 existing near the neutralizer 15 is neutralized.

The neutralization in this specification does not imply that the respective ions in the ion beam 5 are individually coupled with corresponding electrons and complete neutral particles formed. In other words, the neutralization corresponds to a state in which the density of the ion beam 5 and the density of the electron beam captured in the ion beam 5 are equal to each other, and the ions exist as the ion beam 5 per se and the electrons exist as electrons per se, while the electrons are captured in the positive electric field which has been formed by the ion beam 5 itself (hereinafter, this state is referred to as a "plasma state").

In the neutralizer 15, the potential of the ion beam 5 is set to a potential substantially equal to the potential of the filament 17. The potentials of the filament 17 and, accordingly, of the ion beam 5 can be controlled by the second power supply 19. Therefore, when the negative potential is applied from the second power supply 19 to the neutralizer 15 the interior of which is set to the plasma state, a potential gradient occurs between the neutralizer 15 and the sample 7, so that the electrons in the plasma are drifted toward the sample 7. It should be understood that the ion, density and electron density in the ion beam 5 are now caused to be equal. When under this condition in order, to equalize the moving velocity of the electrons irradiated to the sample 7 to the incident velocity of the ion beam 5, the moving velocity of the electrons by the second power supply 19 is controlled, so that the same number of ions and electrons can reach the sample 7 and therefore, the ions are neutralized in the surface region of the sample 7.

This phenomenon can be simply expressed by numerical equations as follows. It is now assumed that a drift energy of the electrons which is required to neutralize the ion beam 5 is "$E_e$", a mass of electrons is "m", a drift velocity of electrons is "$V_e$", an incident energy of ions is "$E_i$", the mass of ion is "M", and an incident velocity of ions is "$V_i$". In this case, $E_e=\frac{1}{2}mVhd\ e^2$ and $E_i=\frac{1}{2}MV_i^2$. When $V_e=V_i$, then $E_e=m/ME_i$ is obtained. Thus, even if a different ion species is introduced, the above relationship can be readily satisfied. Since the mass of an electron is much smaller than the mass of an ion, the neutralization can be generally realized by an energy of about 1 eV. As described in detail above, the second power supply 19, which can drift the emitted thermoelectrons toward the sample 7, functions as control means which can neutralize the ions present in the surface region of the sample 7.

Also, the positive charging phenomenon occurring on the sample 7, which is caused by the emission of the secondary electrons from the sample 7 due to the ion irradiation, can also be eliminated by setting the drift energy of electrons to be high and also by supplying the same amount of electrons as that of the emitted secondary electrons from the neutralizer 15 to the ion beam 5, so that neutralization on the surface of the sample 7 can be maintained.

Furthermore, if the potential of the sample 7 varies due to a small charging, the drift energy of electrons also changes in response to this potential fluctuation, and thus, the amount of electrons provided can be automatically adjusted.

As mentioned above, since the thermoelectron shielding electrode 20 is biased to a negative potential with respect to the potential of the filament 17 by the third power supply 21, scattering of the thermoelectrons to the outside of the neutralizer 15 can be avoided. The electrons can be supplied to the ion beam 5 at high efficiency. The direct irradiation of the thermoelectrons to the sample 7 is also prevented. The shielding electrode 22 prevents the electrons in the ion beam from being drifted in the direction of the ion source 8, thereby enabling the electrons in the ion beam to be efficiently supplied in the irradiating direction of the sample 7.

The ion beam irradiating apparatus according to a first preferred embodiment of the invention will now be summarized.

The ion beam irradiating apparatus according to the invention comprises: a thermoelectron emitting source for supplying thermoelectrons to an ion beam and forming the plasma state therein; and control means for drifting the thermoelectrons toward a sample, thereby neutralizing the ions in the surface region of the sample.

The ion beam irradiating apparatus of the invention is characterized in that an ion beam is set to the plasma state by the thermoelectrons emitted from the thermoelectron emitting source positioned at an arbitrary position between a sample and a mass separator to separate only the ion species necessary for ion implantation from the ion beam, the electron beam is drifted toward the sample by using the potential gradient between the ion beam and the sample due to the control means, thereby neutralizing the electric charges of the ions in the surface region of the sample.

In the first preferred embodiment, the neutralizer 15 has been employed, for example, between the sample 7 and the aperture 14 for allowing only the mass separated specified ion species to pass. However, the neutralizer may be also set at the position of the aperture 14, and the aperture, neutralizer aperture 24 may be merged into a single aperture.

In the above described embodiment, a sample having an electrical insulating structure was assumed to have been used. However, the present invention is not limited to this case, but may be also applied to any ion beam irradiating apparatus such as ion implanting apparatus or a machining apparatus, of a semiconductor or insulating material. An advantageous effect similar to that in the foregoing embodiment can also be obtained for a conductive target. On the other hand, although the control means has been constructed to be supplied by the second power supply 19, it is not limited to this construction. Further, although a filament was used as a thermoelectron emitting source, other electron emitting means may be also used.

As described above, according to the first preferred embodiment, thermoelectrons are supplied to an ion beam to change the ion beam into a plasma state, and the electron beam is drifted toward a sample by the control means. Therefore, there is a particular advantage such that the electron charges of ions floating in the surface region of the sample can be neutralized independent of the ion beam density.

ION NEUTRALIZER OPERATED IN SECOND MODE

Proceeding with the detailed description of an ion neutralizer according to a second embodiment of the invention, a charging condition on the surface of the sample 9 the entire surface of which is made of an insulating material, which is obtained by use of the ion neutralizer 15 of the first embodiment, will be considered.

Figure 4:
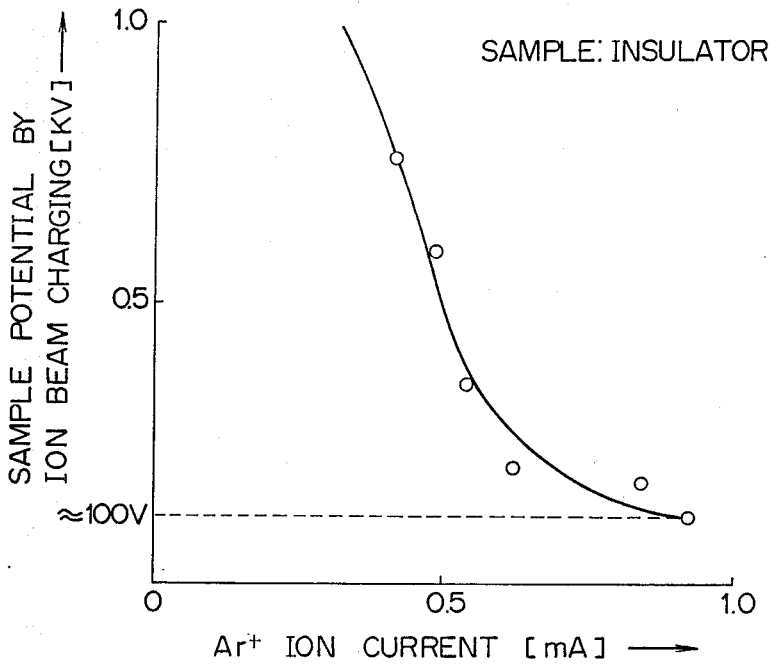
FIG. 4 is a graphic representation of a relationship between a sample potential and ion current according to the first preferred embodiment.

FIG. 4 is a graphic representation of the neutralizing characteristic showing a charging condition on the surface of a sample, the entire surface of which is made of an insulating material, with respect to a change in ion beam current which is obtained by use of the neutralizer 15 shown in FIG. 3. The abscissa indicates an $Ar^+$ ion current (mA) and the ordinate represents a potential (kV) due to the charging of an ion beam.

In the ion beam irradiating apparatus as shown in FIG. 2, for example, when a current value of the ion beam 5 is changed by controlling the power supply 11, the emission surface of the ion beam 5 of the ion source 8 changes and therefore, the orbit of the ion beam 5 changes. Thus, the density distribution and shape of the ion beam 5 existing near the neutralizer 15 will change. Therefore, as shown in the graphic representation of FIG. 4, the potential due to the charging on the sample surface fluctuates with respect to the current value of the ion beam 5. In other words, negative charging will be caused by the primary electrons or the reflected electrons, and an amount of the emitted secondary electrons will change and the charging condition of the sample surface will also change.

To prevent such changes, the ion neutralizer according to the second preferred embodiment has been proposed. An arrangement of this neutralizer will be described hereinbelow with reference to FIG. 5.

The same or similar parts and components as those shown in the ion beam irradiating apparatus in the first embodiment shown in FIGS. 2 and 3 will be designated by the same reference numerals.

Figure 5:
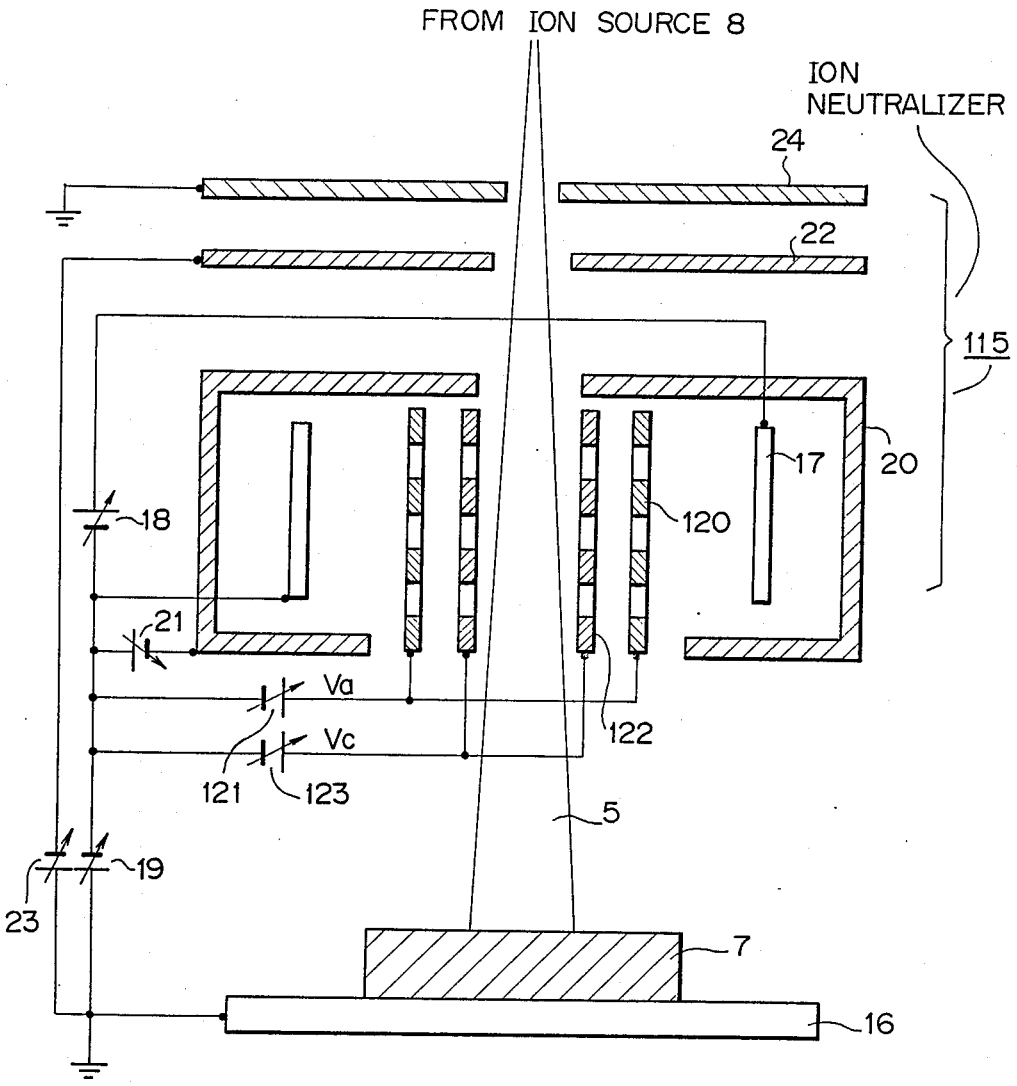
FIG. 5 is a detailed arrangement of an ion neutralizer according to a second preferred embodiment.

In FIG. 5, an electron drawing electrode 120 is positioned between the filament 17 and the orbit of the ion beam 5, and functions as electron drawing means to draw thermoelectrons from the filament 17 by means of a fifth power supply 121. An electron energy controlling electrode 122 is arranged between the electron drawing electrode 120 and the orbit of the ion beam 5, and functions as electron energy control means for controlling the energy of the electrons drawn by means of a sixth power supply 123. Negative terminals of the fifth and sixth power supplies 121 and 123 and one end of the filament 17 are connected so as to have the same potential, as shown in the circuit diagram. Each of the electron drawing electrode 120 and electron energy control electrode 122 is, for example, in a grating shape so that the electron beam drawn from the filament 17 can pass through this electrode which is made of a material such as molybdenum or the like having a high melting point.

The other parts and components, such as first scattering preventing means 20 and the like, are the same as those shown in FIG. 3. Therefore, their descriptions are omitted here.

STABLE NEUTRALIZING OPERATION

The operation of the second embodiment will now be explained. The filament 17 is heated by means of the first power supply 18 to such a high temperature that the filament can sufficiently emit thermoelectrons. The filament 17 is set to the minus side and the electron drawing electrode 120 is set to the plus side and a voltage "$V_a$" is applied by means of the fifth power supply 121. If the temperature of filament 17 is high enough to clear the space charge region, the space charge equation by Poisson is satisfied. An electron current density "$J_e$" is given by $J_e = K_1 V_a^{3/2}$. "$K_1$" is a coefficient which is determined in dependence on the initial velocity of electrons, the distance between the electrodes, electrode shape, or the like. It will be understood from this space charge equation that the electron current density "$J_e$" is increased or decreased in accordance with the 3/2 power of the drawing voltage. Next, the filament 17 is set to the minus side and the electron energy controlling electrode 122 is set to the plus side and a voltage of "$V_c$" is applied by means of the sixth power supply 123. In this case, if $V_c = V_a$, both electrodes 120 and 122 are biased to the same potential, so that the thermoelectron beam drawn by the voltage "$V_a$" can pass through the electrode 122 with its own present energy maintained. On the other hand, assuming that $V_c = 0$, the thermoelectron beam accelerated by the electrode 120 is promptly decelerated as it approaches the electron energy control electrode 122 and is eventually stopped near this energy control electrode 122. Therefore, for example, when the voltage of $V_c = 10$ V is applied, the electron beam having the energy of 10 eV is moved from the electron energy controlling electrode 122 in the direction of the orbit of the ion beam.

As illustrated in FIG. 2, the ion beam 5 drawn from the ion source 8 passes through the mass separator 13 and enters the neutralizer 115 in this embodiment. Even if an ion beam 5 having different ion density distribution, cross-sectional shape thereof, or diameter enters into the neutralizer 115, both the electron energy and the amount of electrons adapted to the electron capture cross-sectional area of the ion beam 5 in the neutralizing region of the neutralizer 115 can be taken into the volume of the ion beam 5 by controlling the electron energy by way of the electron energy control electrode 122. As a result, the plasma condition in which the ion density and electron density are equal to each other can be formed. The subsequent ion neutralization operations have already been described in the first embodiment of FIGS. 2 and 3, hence no further explanation is provided.

Figure 6:
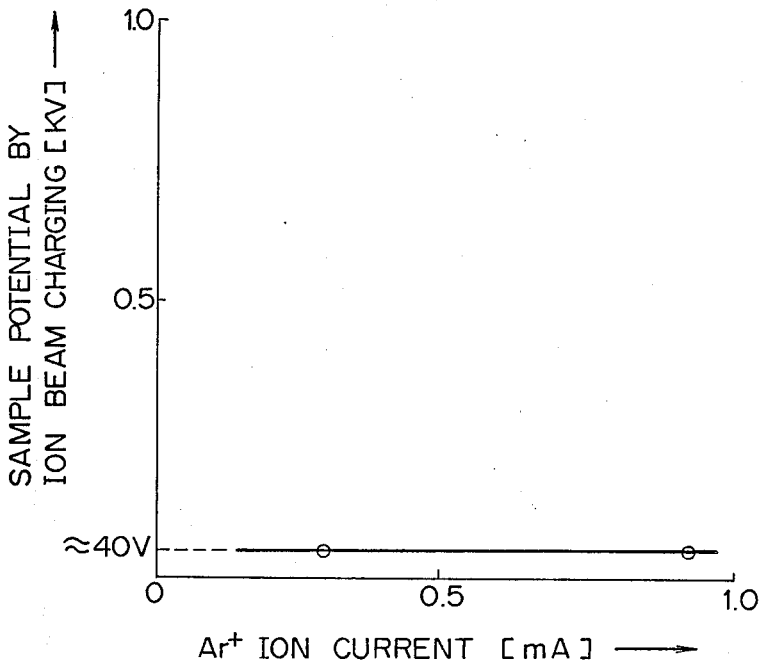
FIG. 6 is a graphic representation of a relationship between a sample potential and ion current according to the second preferred embodiment.

FIG. 6 shows the neutralizing characteristic achieved by using the ion neutralizer 115 of the preferred embodiment in the ion beam irradiating apparatus. As will be obvious from this graphic representation, the potential of the sample by the charging becomes low and constant irrespective of an amount of ion current. Therefore, even if the density distribution of the ion beam 5, beam shape, and current amount thereof change, the ions floating to the sample surface can be continuously, stably neutralized.

In the present embodiment, for example, the neutralizer 115 has been positioned at the place of the aperture for allowing only the specified ion species which were mass-separated to pass. However, since the neutralization can be performed independently of the shape of ion beam 5, if the ion beam 5 can penetrate the interior of the neutralizer 115, the neutralizer may be set at an arbitrary position between the mass separator 13 and the sample 7.

On the other hand, in accordance with the energy of the ion beam 5, the electron energy can be controlled so as to form the ion beam 5 and provide a plasma state. Therefore, the invention is not limited to the ion beam implantation, but may be also applied to the processes such as working, film formation, and the like for semiconductor and insulator and can be freely utilized in such apparatuses. Further, with respect to the process to form a composite film e.g., $SiO_2$ to metal, and an apparatus to realize such a process, the particular advantage similar to those obtained with the foregoing embodiment may also be achieved.

The shapes of the electrodes 120 and 122 are not limited to the grating-shapes, but may be formed in any shapes through which an electron beam can pass.

In addition, the method of applying a specified electric potential to each component is not limited to the foregoing potential applying method.

As explained above, according to the just described embodiment, the ion beam neutralizer is characterized by comprising: an electron beam emitting source to generate electrons; an electron beam drawing electrode for drawing the electron beam generated from the electron beam emitting source toward an orbit of an ion beam; an electron energy control electrode for controlling an energy of electrons drawn; a first electron scatter preventing electrode for preventing the electron beam generated by the electron beam emitting source from being scattered to the outside thereof; and a second electron scatter preventing electrode for preventing the electron beam drawn onto the ion beam orbit and induced to the ion beam from being scattered in the direction opposite to the irradiating direction of the ion beam. Therefore, there are particular advantages in that the probability of electron capture by the ion beam can be set to a maximum value by controlling the electron energy irrespective of a change in current density of ions or the like, and the electric charges of ions on the sample surface can be neutralized irrespective of the current density, shape, or the like of the ion beam.

ION NEUTRALIZER WITH SECONDARY ELECTRON STOPPING MEANS

As previously described, in the neutralizer 115 using the electron drawing electrode 120 and electron energy controlling electrode 122 shown in FIG. 5, a potential gradient occurs between the neutralizer 115 and the sample 7, by applying a negative potential from the second power supply 19 to the neutralizer 115 the inside of which is in the plasma state, so that the thermoelectrons in the plasma move toward the sample 7. Since the ion density and electron density in the ion beam 5 are now equal to each other, ions and electrons of the same amount therewith reach the sample 7 by controlling the moving velocity of the electrons by means of the second power supply 19 so as to equalize the moving velocity of the electrons to the sample 7 with the incident velocity of the ion beam, and accordingly, the ions can be completely neutralized on the surface of the sample 7.

On the other hand, since secondary electrons are emitted from the surface of the sample 7 by the ion irradiation, the sample 7 is likely to become positively charged. In this case, it is necessary to increase the electron kinetic energy and to supply the same amount of electrons as the emission amount of second electrons from the neutralizer 115 and to thereby maintain the surface of the sample 7 to a low potential.

For this reason, an ion neutralizer with secondary electron stopping means in the third preferred embodiment has been proposed.

Figure 7:
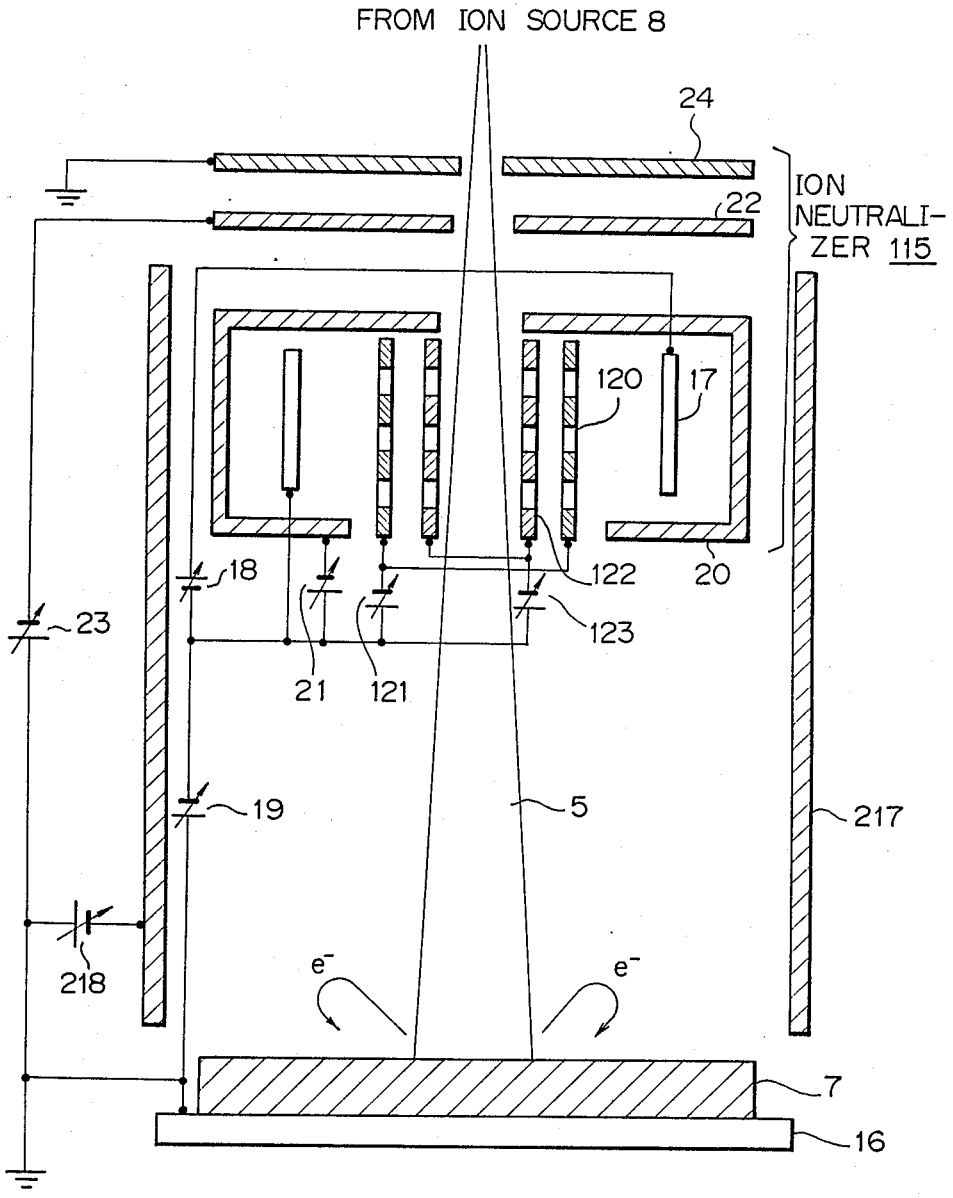
FIGS. 7 through 9 schematically show an arrangement of an ion neutralizer employing a secondary electron stopping means according to a third preferred embodiment.

FIG. 7 shows an ion neutralizer with secondary electron stopping means in the third preferred embodiment. The same or similar parts and components as those in the ion neutralizer 115 in the second embodiment will be designated by the same reference numerals and the descriptions of their functions are omitted.

As will be obvious from FIG. 7, the ion neutralizer 115 in this embodiment is constructed in substantially the same manner as the ion neutralizer 115 inthe second embodiment in FIG. 5. Therefore, the secondary electron stopping means provided for the neutralizer of the third embodiment will be explained hereinbelow.

That is, this secondary electron stopping means is arranged by a secondary electron emission blocking electrode 217, one end of which is located near the sample 7 and which surrounds the sample 7 and neutralizer 115. This electrode 217 is set to a negative potential for the sample 7 by a seventh power supply 218.

BLOCKING OPERATION FOR SECONDARY ELECTRON EMISSION

The operation of the third embodiment will now be explained. The ion beam 5 is induced into the neutralizer 115 with the condition that the ion density and electron density are equal to each other and the velocities of the ions and electrons are almost equal to each other. These charged particles are thus, in the plasma state in which the ions operate as an ion beam per se and the thermoelectrons operate as a thermoelectron current per se, while the electrons are captured in the positive electric field which is formed by the ion beam itself. In this state, the ion beam 5 reaches the sample 7. In this case, the ions and electrons are recombined on the surface of the sample 7 and neutralized. However, any secondary electrons ($e^-$) that are emitted from the sample 7 by the incident energy and removed and scattered from the sample 7 to the outside, so that the sample surface is positively charged. However, in this embodiment, since the space near the sample surface is surrounded at a negative potential provided by the secondary electron emission blocking electrode 217, the emitted secondary electrons are immediately returned to the sample surface.

MODIFIED SECONDARY ELECTRON EMISSION BLOCKING ELECTRODES

Figure 8:
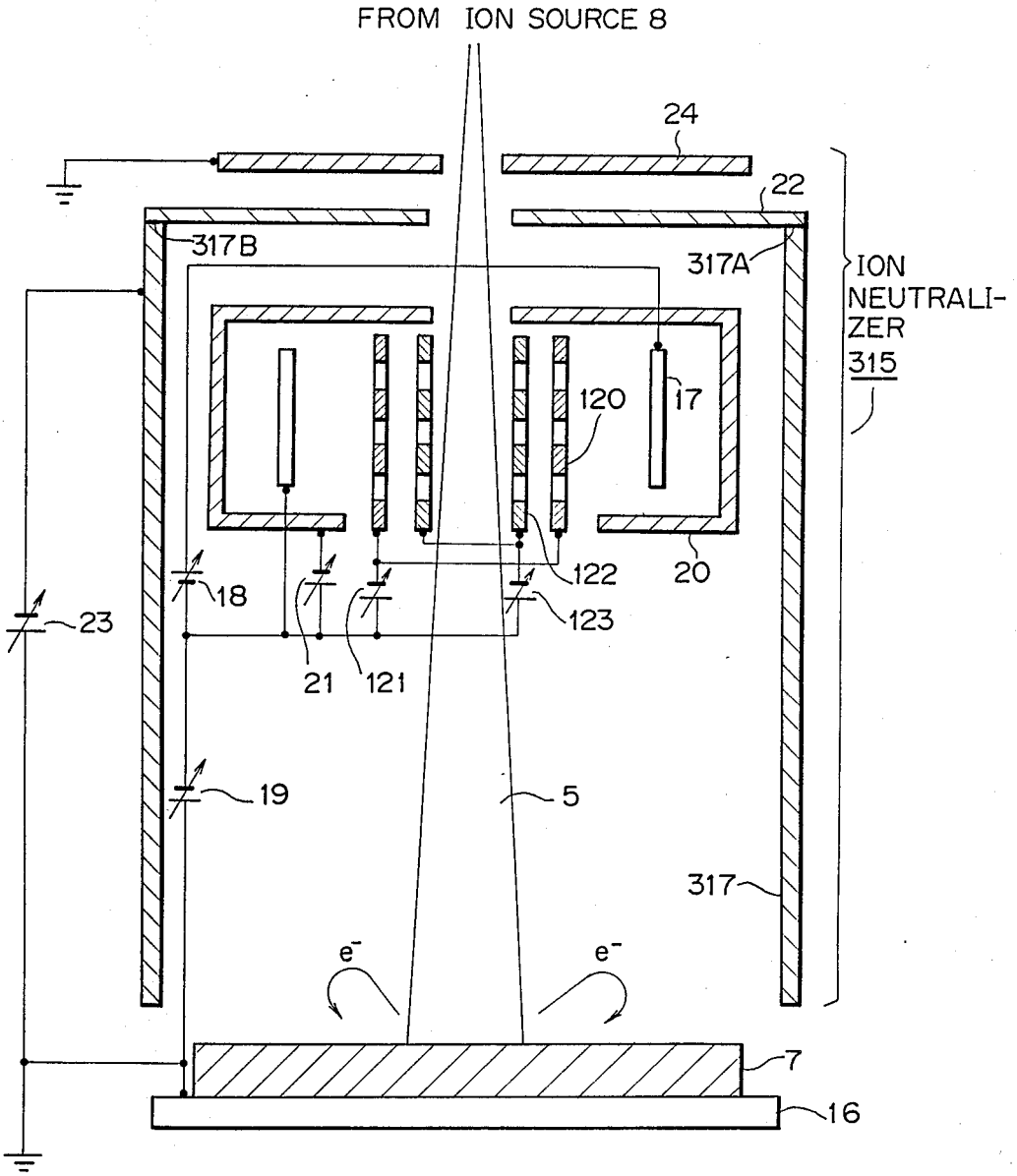
Figure 9:
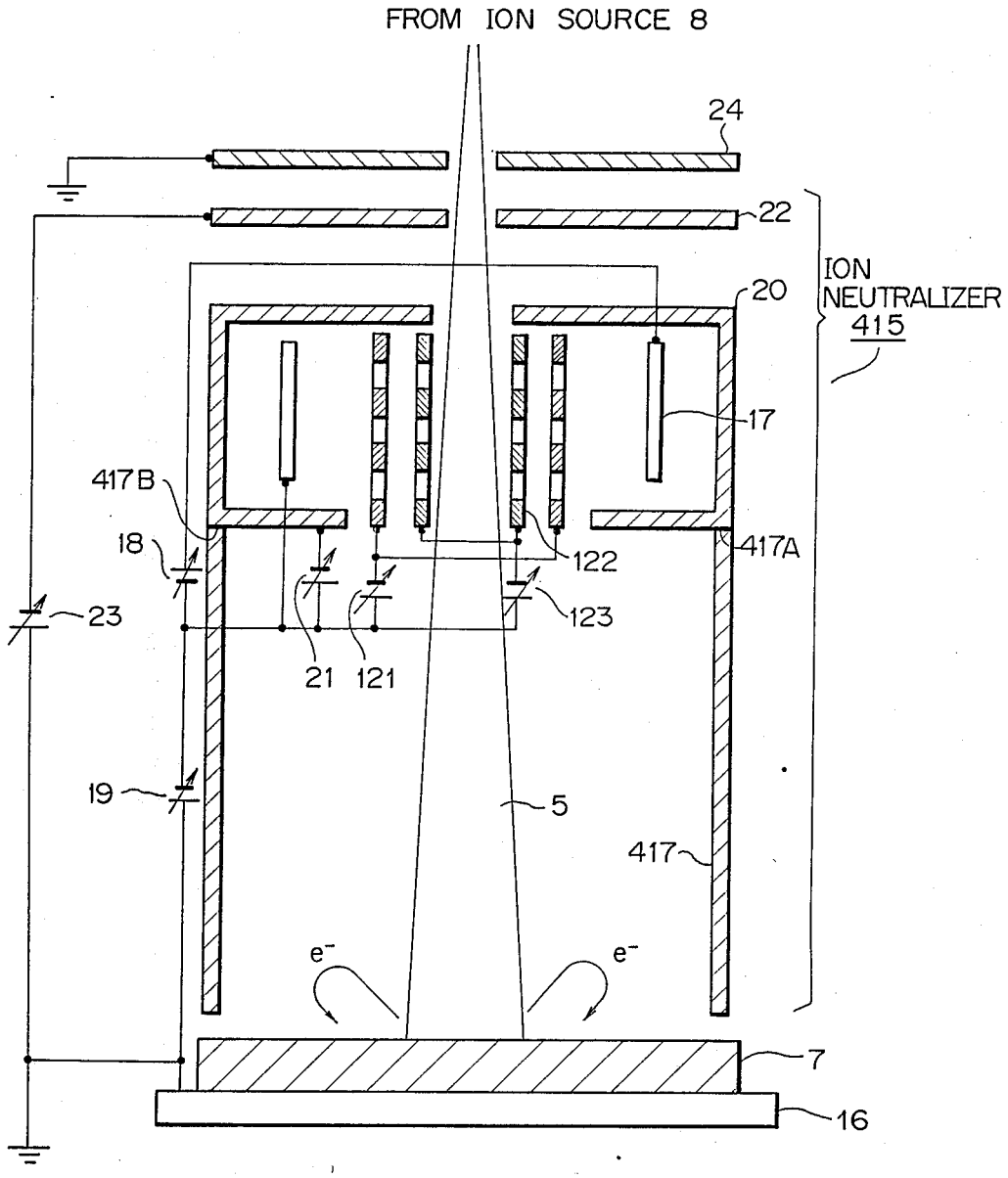

In the embodiment of FIG. 7, an explanation has been provided with respect to the case where, in order to prevent the emission of the secondary electrons from the surface of the sample 7, the secondary electron emission blocking electrode 217 and the seventh power supply 218 to apply a negative potential are provided separately from the ion neutralizer 115. However, in an ion neutralizer 315 shown in FIG. 8, a secondary electron emission blocking electrode 317 and the shielding electrode 22 serving as the second scattering preventing means are coupled at junction points 317A and 317B, and the fourth power supply 23 also has the same function as the seventh power supply 218 in FIG. 7. Further, in an ion neutralizer 415 as shown in FIG. 9, a secondary electron emission blocking electrode 417 and the thermoelectron shielding electrode 20 serving as the first scattering preventing means are coupled at junction points 417A and 417B, and the second power supply 19 and the third power supply 18 also have the function of the seventh power supply 218 to apply a negative potential shown in FIG. 8.

As explained above, according to the third embodiment, the long shielding electrodes 217, 317, and 417 biased at the negative potentials are arranged in the direction from the neutralizer to the sample 7 such as an insulating substrate. Accordingly, the emission of the secondary electrons which are generated when the ion beam 5 is irradiated onto the substrate can be suppressed.

Further, according to the constructions of those ion neutralizers, the sample holder 16 including the sample 7 has the same function as a well-known Faraday cup. The secondary electron emission blocking electrodes 217, 317, and 417 have the same function as a well-known suppressor electrode. Thus, when the ions are implanted, a difference in dose does not occur and an injection amount of the ion can be also detected continuously.

On the other hand, although the third embodiment has been described with respect to the ion implanting apparatus of a semiconductor, the invention may be also applied to an ion beam irradiating apparatus of ion beam working apparatus, film forming apparatus, or the like for semiconductor or insulator. Further, the particular advantages similar to those obtainable with the first and second embodiments can also be achieved with respect to the process and apparatus to form a composite film of, for example, $SiO_2$ or the like on a metal.

As described above, according to the third preferred embodiment, the ion beam irradiating apparatus for irradiating an ion beam onto the surface of a sample is characterized by comprising: an emitting source to generate an electron beam; an electron beam drawing electrode for drawing the electron beam from the electron beam emitting source; an electron energy control electrode for controlling an energy of the drawn electron beam; a first electron scatter preventing electrode for preventing the electron beam generated by the electron beam emitting source from being scattered to the outside thereof; and a second electron scatter preventing electrode for preventing the electron beam drawn onto an orbit of an ion beam and induced to the ion beam from being scattered in the direction opposite to the irradiating direction of the ion beam. In this ion beam irradiating apparatus, there is provided a secondary electron stopping electrode for surrounding the periphery of the sample biased at a negative potential, so that the secondary electrons which are emitted from the sample due to the irradiation of the ion beam can be sufficiently suppressed. Thus, there are particular advantages in that the amount of secondary electrons which are emitted from the sample can be minimized, and the ion beam can be stably neutralized with high accuracy.

ION NEUTRALIZER OPERATED IN FOURTH MODE

The neutralizing operation of the ion neutralizer 115 in the second embodiment shown in FIG. 5 will now be simply explained again.

Thermoelectrons can be induced into the ion beam 5 by properly selecting the positive voltage $V_c$ of the sixth power supply 123 which is applied to the electron energy controlling electrode 122, and also the positive voltage $V_a$ of the fifth power supply 121 which is applied to the electron drawing electrode 120. Thus, the above-described plasma condition can be formed. In this state, the thermoelectrons in the ion beam 5 move toward the sample 7 under the influence of the potential gradient due to the negative potential between the power supply 19 and the sample 7. By controlling the negative voltage which is applied from the power supply 19, the number of ions and the number of thermoelectrons which reach the surface of the sample 7 are equalized to each other and the sample surface is electrically neutralized.

The electrons which are supplied to the ion beam 5 from the neutralizer 115 have a kinetic energy corresponding to the voltage $V_c$ in the direction perpendicular to the irradiating direction of the ion beam 5. Therefore, the electrons which have entered into the ion beam 5 from the neutralizer 115 traverse the ion beam orbit and are returned to the electron energy controlling electrodes 122, electron drawing electrodes 120, and electron beam emitting sources 17 which are arranged at the opposite positional relationship. The supplying efficiency of the electrons is thus deteriorated. There is also a case where the drawing operation of electrons is obstructed by the space charges of the electrons returned and the drawing efficiency of the electrons is deteriorated. Further, since the electrons induced into the ion beam 5 do not have an initial velocity in the irradiating direction of the ion beam 5, there is a fact that unless a potential gradient of positive voltage more than $V_c$ is applied between the ion beam 5 and the sample 7, the electrons are difficult to move toward the sample 7. As a result, since the electrons have a high energy, there is also a risk such that the sample 7 is broken.

Figure 10:
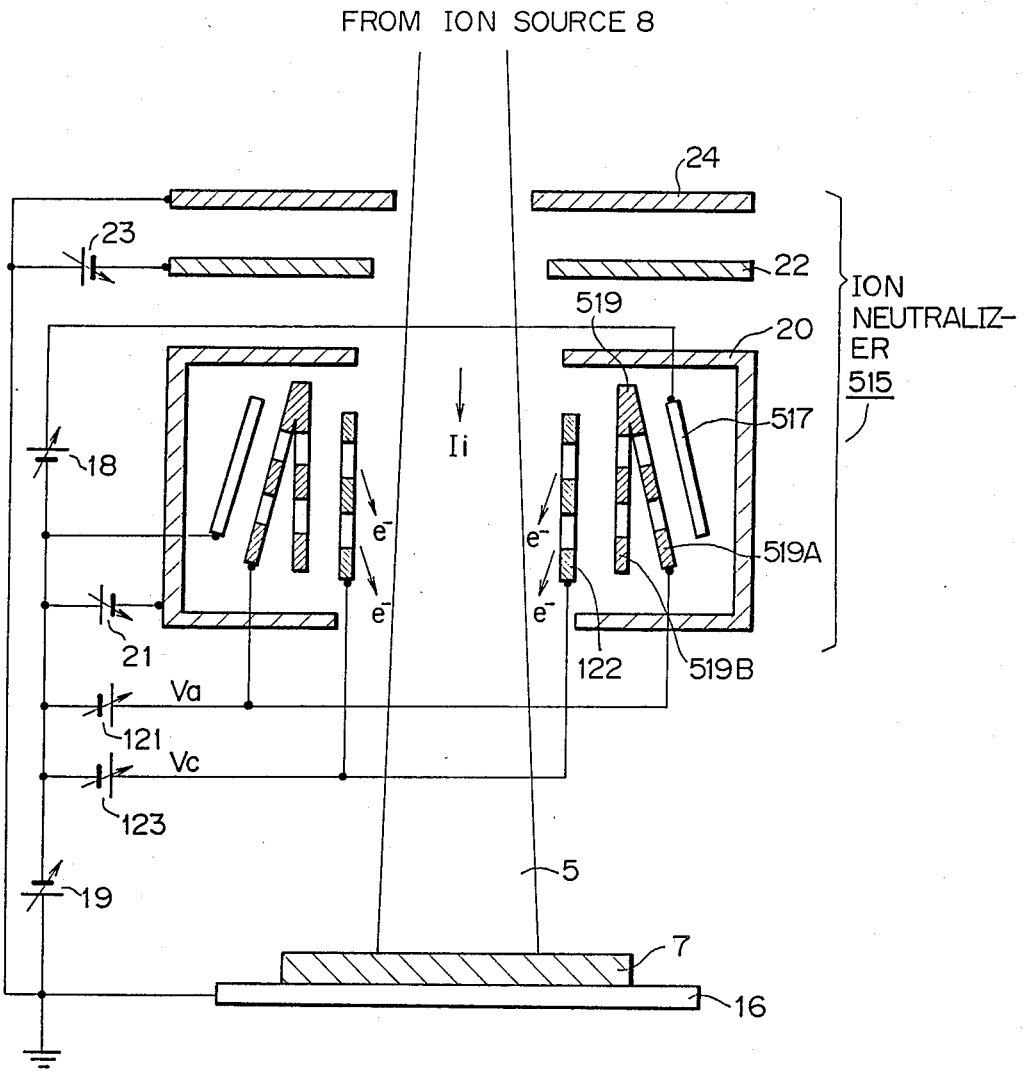
FIG. 10 schematically illustrates an arrangement of an ion neutralizer according to a fourth preferred embodiment.

To eliminate the foregoing risk, an ion neutralizer 515 as shown in FIG. 10 has been proposed.

In order to allow electrons supplied to an ion beam to have the components which are directed to the sample side, the ion beam neutralizer according to the fourth preferred embodiment comprises: an electron beam emitting source to generate an electron beam; an electron drawing electrode for drawing the electron beam generated by the electron beam emitting source toward the ion beam; and an electron energy control electrode for decelerating the electron beam drawn by the electron drawing electrode.

In such an ion neutralizer, the components which are directed to the sample side are given to the electron beam which is supplied to the ion beam by the arrangement of the electron beam emitting source, electron drawing electrode, and electron energy control electrode. Therefore, after the electron beam entered into the ion beam, a reverse flow of the electron beam to the electron energy control electrode, electron drawing electrode, and electron beam emitting source which are arranged at the opposite positional relationship can be suppressed. Thus, the supplying efficiency of the electrons is increased and the electrons can be easily moved toward the sample.

FIG. 10 shows a detailed construction of the ion neutralizer 515 according to the fourth embodiment.

In FIG. 10, an electron beam emitting source 517 is obliquely arranged such that the side thereof facing the sample 7 is widened in the irradiating direction (indicated by an arrow $I_i$) of the ion beam 5. An electron drawing electrode 519 has a V-shaped cross section which is widened toward the sample 7. One plane 519A of this V-shaped drawing electrode is arranged substantially parallel with the electron beam emitting source 517 whereas the other plane 519B is arranged substantially parallel with the electron energy controlling electrode 122.

The other parts and components, such as the shielding electrode 22 and the like, are the same as those in FIG. 3. Therefore, their descriptions are omitted.

HIGHER ELECTRON BEAM SUPPLY

The ion neutralization operation of the ion neutralizer 515 in the fourth embodiment shown in FIG. 10 will now be described in detail hereinbelow with reference to FIG. 11.

The electron beam emitting source 517 is almost parallel with one plane (hereinafter, referred to as "an electron incoming plane") 519A of the electron drawing electrode 519. The other plane (hereinafter, referred to as "an electron outgoing plane") is 519B of the electron drawing electrode 519. The electron energy controlling electrodes 122 are almost parallel with the irradiating direction (arrow $I_i$) of the ion beam 5. It is assumed that an angle between the electron incoming plane 519A and the electron outgoing plane 519B is defined by "$\theta$". In other words, the electron drawing direction by the electron drawing electrode 519 is shifted by only the angle $\theta$ from the electron decelerating direction by the electron energy controlling electrode 122.

The electron beam ($e^-$) drawn from the electron beam emitting source 517 by the electron drawing electrode 519 vertically enters into the electron incoming plane 519A and directly advances straight to the electron outgoing plane 519B. At this time, a velocity "$v_1$" of the electron beam is determined by the voltage "$V_a$" of the fifth power supply 121 applied to the electron drawing electrode 519.

$$v_1 = \sqrt{\frac{2eV_a}{m}} \quad (1)$$

where, "e" is an amount of negative charge in an electron and "m" is the mass of an electron.

The electron beam is then decelerated by the electron energy controlling electrode 122. The decelerating direction is vertical to the electron outgoing plane 519B and electron energy controlling electrode 122. On the other hand, a velocity component "$v_z$" in the direction which is parallel with the controlling electrode 122 corresponding to the value of $$v_z = v_1 \sin\theta \ldots \quad (2)$$

is held in the deceleration.

On the other hand, the energy of the decelerated electron beam is determined by the voltage "$V_c$" of the sixth power supply 123 applied to the electron energy controlling electrode 122. A velocity "$v_2$" at this time is $$v_2 = \sqrt{\frac{2eV_c}{m}} \quad (3)$$

Therefore, the electron beam which moves from the electron energy controlling electrode 122 to the ion beam 5 is emitted from the electrode 122 at an emitting angle "$\alpha$". Therefore, from the equations (1) to (3), $$\cos^{\alpha} = \frac{v_z}{v_2} = \sqrt{\frac{V_a}{V_c}} \sin\theta \quad (4)$$

However, when the right size $$V_a/V_c \sin\theta$$

in equation (4) has a value of 1 or more, the electron beam cannot pass through the controlling electrode 122.

In equation (4), for example, when an electron beam is drawn at the voltage $V_a = 300$ V and the electron energy is set to $V_c = 10$ V, if $\theta = 0°$, the electron beam is emitted vertically ($\alpha = 90°$ and this case corresponds to the conventional ion neutralizer). However, if $\alpha = 10°$, the electron beam is emitted at the angle of $\alpha = 18°$. Therefore, the electron beam emitted from the controlling electrode 122 and supplied to the ion beam 5 has the velocity component $v_z$ in the direction of the sample 7. The electron beam is prevented from being directly returned to the electron energy controlling electrodes 122, electron drawing electrodes 519, and electron beam emitting sources 17 which are arranged at the opposite positional relationship through the ion beam 5. The supplying efficiency of the electron beam is improved according to this preferred embodiment. On the other hand, since the electron beam has the initial velocity component "$v_z$" in the direction of the sample 7, by merely giving a small potential gradient between the neutralizer 515 and the sample 7 by the fourth power supply 19, the electron beam can be easily moved toward the sample 7.

MODIFICATIONS OF ELECTRON MOVING CONTROL

Figure 11:
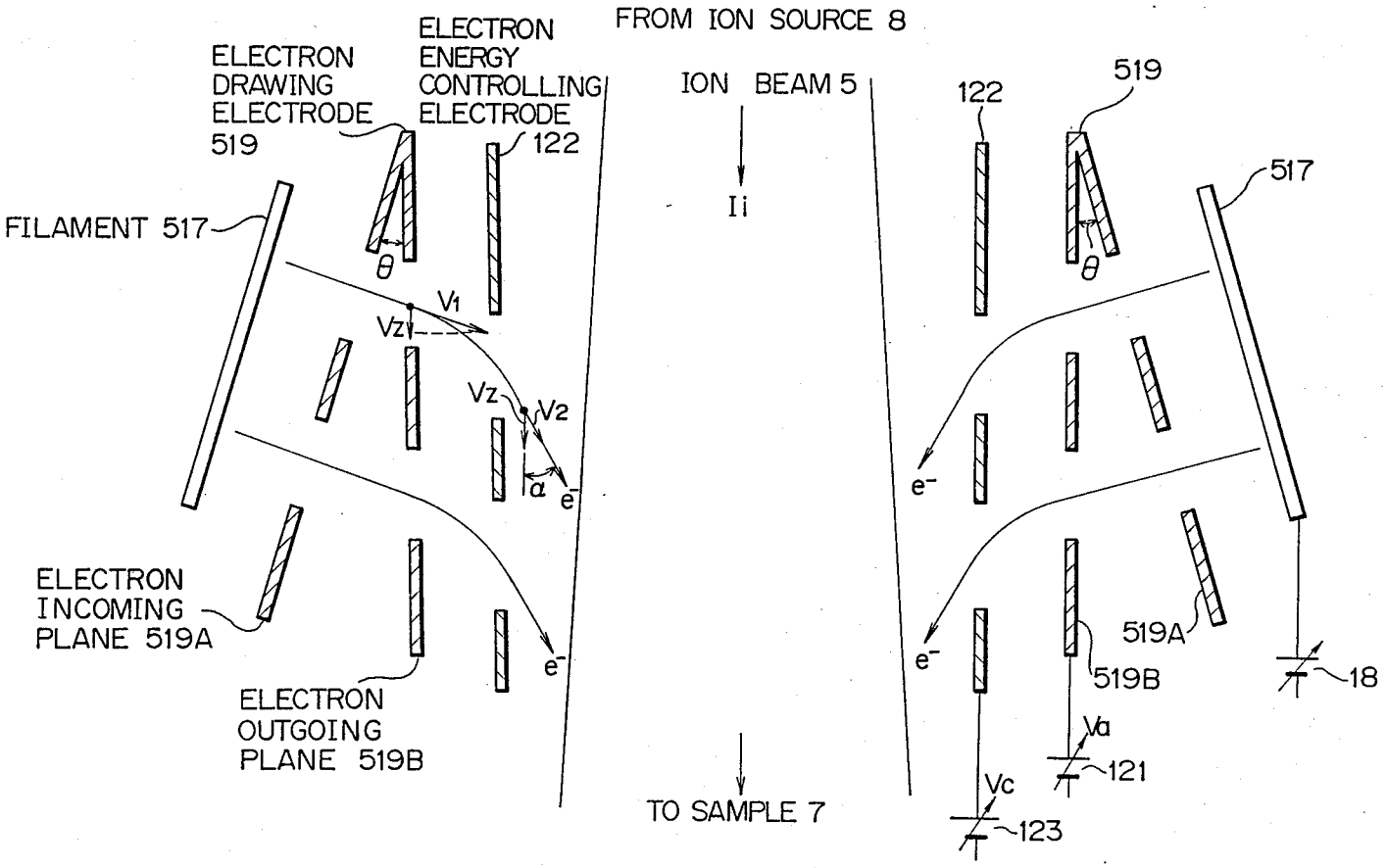
FIG. 11 is an illustration for explaining velocity control of thermoelectrons of the ion neutralizer shown in FIG. 10.
Figure 12A:
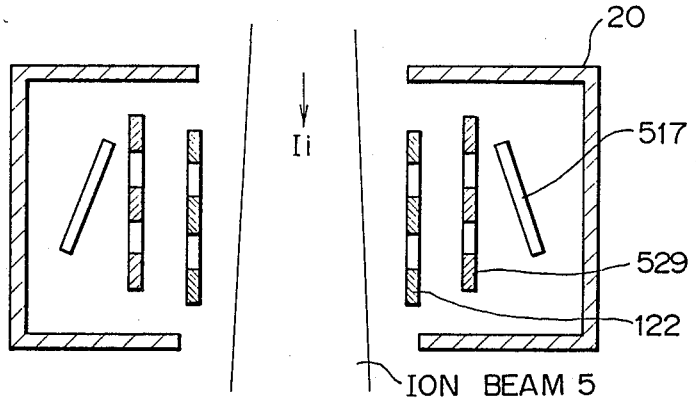
FIGS. 12 to 15 schematically show modifications of the ion neutralizers according to the fourth preferred embodiment of the invention.
Figure 12B:
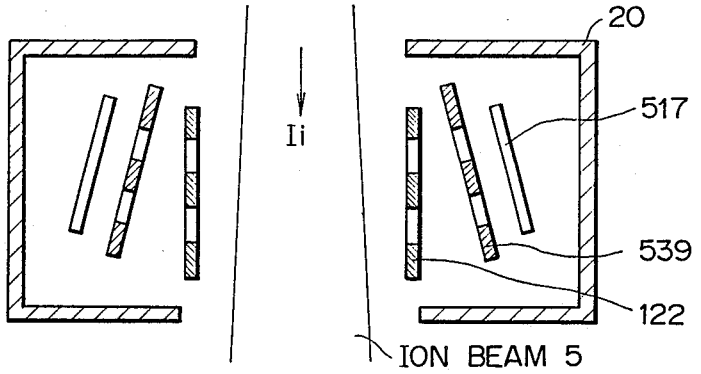
Figure 12C:
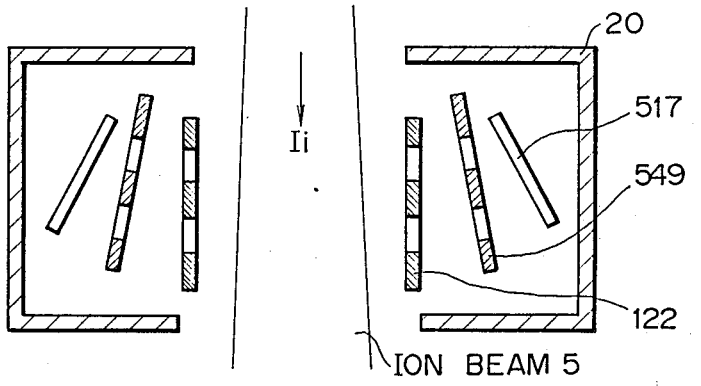

In the embodiment shown in FIGS. 10 and 11, the explanation has been made with respect to the case where the electron drawing electrode 519 has a V-shaped cross section, the electron beam emitting source 517 and electron incoming plane 519A are parallel to each other, and the electron outgoing plane 519B and electron energy controlling electrode 122 are parallel to each other. As shown in FIGS. 12A, 12B, and 12C, electron drawing electrodes 529, 539, and 549 are not limited to V-shaped cross sections, but it is sufficient to arrange these electrodes in the following manner. That is to say, the electron drawing direction by means of the electron drawing electrode 519 is different from the electron beam decelerating direction by means of the electron energy controlling electrode 122. The particular advantages similar to the foregoing embodiments may be also achieved in these modifications.

Figure 13:
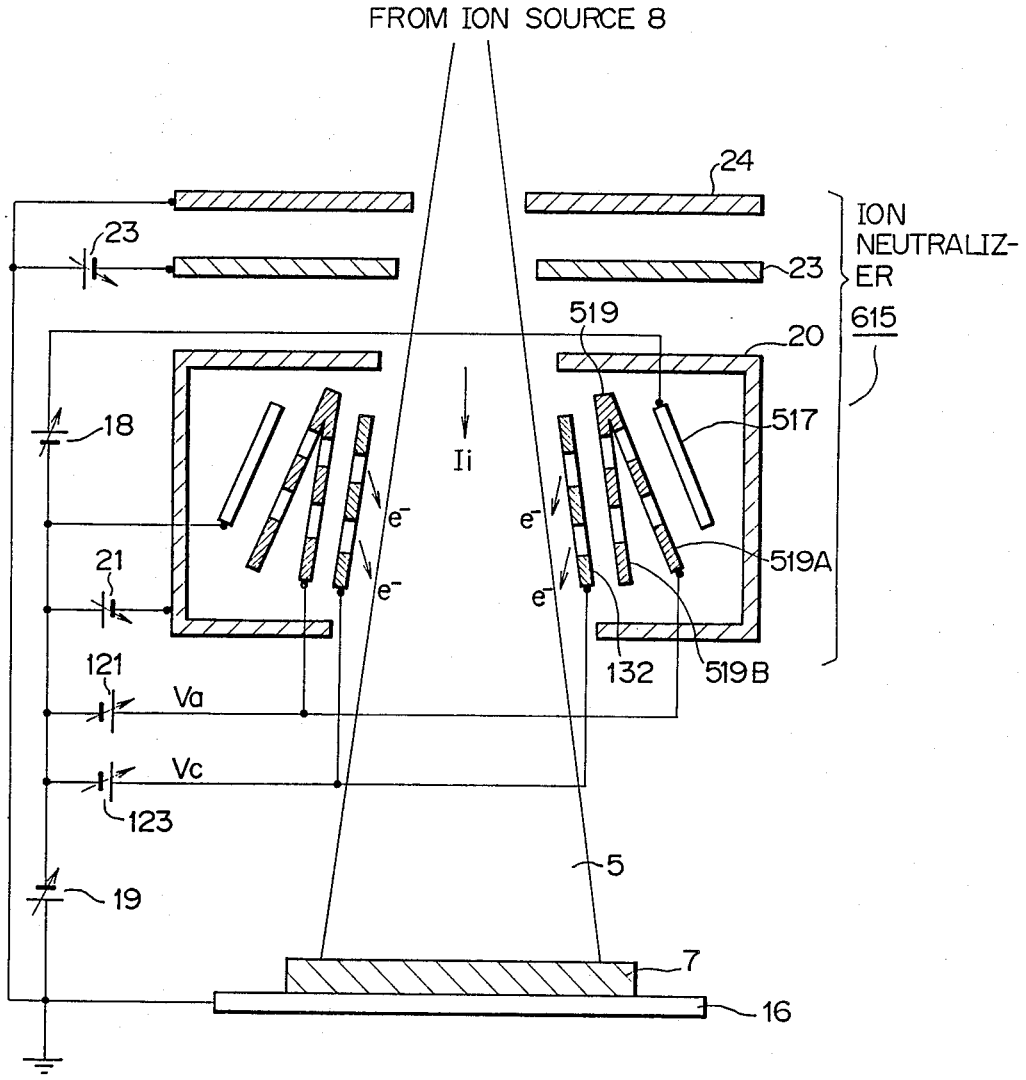

On the other hand, in the embodiments as illustrated in FIGS. 9 to 12, an explanation has been provided with respect to the case where the electron energy controlling electrode 122 is parallel with the irradiating direction (indicated by the arrow $I_i$) of the ion beam 5. However, as shown in FIG. 13, particular advantages similar to those provided by the foregoing embodiments may also be also obtained in the case where an electron energy controlling electrode 132 is not parallel with the irradiating direction (arrow $I_i$) of the ion beam 5, as illustrated in an ion neutralizer 615 in FIG. 13.

Figure 14:
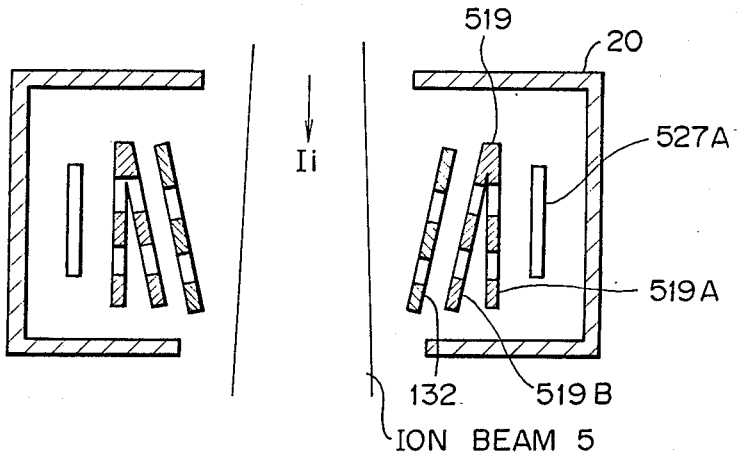

In addition, in the previous embodiments shown in FIGS. 9 to 13, an explanation has been provided with respect to the case where the initial velocity component "$v_z$" in the direction of the sample 7 of the electron beam is maintained when the electron beam is drawn by the electron drawing electrode 519, 529, 539, or 549. However, the invention is not limited to this case. For instance, as shown in FIG. 14, the velocity component "$v_z$" in the direction of the sample 7 is not produced when an electron beam is drawn in the case where the electron beam emitting source 527A and the electron incoming plane 519A of the electron drawing electrode 519 are parallel with the irradiating direction (indicated by the arrow $I_i$) of the ion beam 5, and the electron outgoing plane 519B of the electron drawing electrode 519 and the electron energy controlling electrode 132 are narrowed toward the irradiating direction (the arrow $I_i$) of the ion beam 5 at the sample sides thereof. However, since the velocity component in the direction of the sample 7 is produced when the electron beam is decelerated by the controlling electrode 132, the particular advantages similar to those obtained with the foregoing embodiments can also be achieved.

Figure 15A:
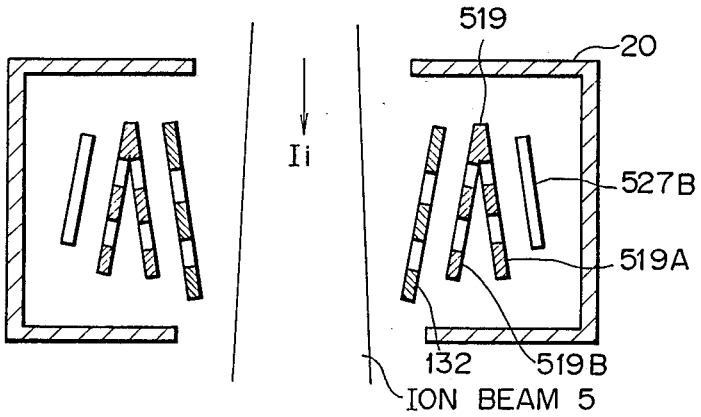
Figure 15B:
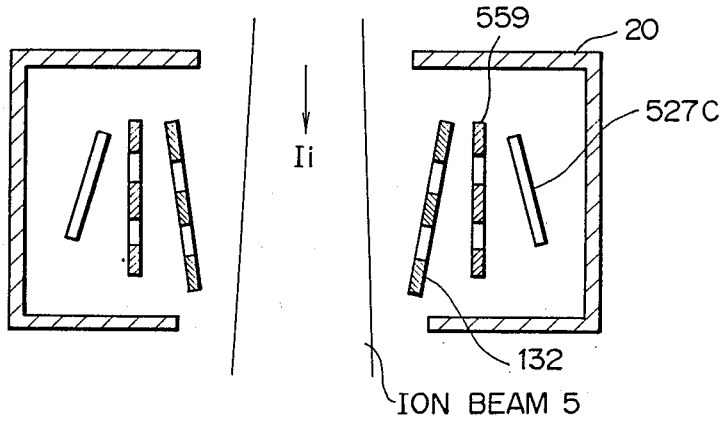

Further, as shown in FIGS. 15A and 15B, in the case where electron beam emitting sources 527B and 527C are widened toward the irradiating direction (the arrow $I_i$) of the ion beam 5 at the sample sides thereof and the electron energy controlling electrode 132 is narrowed toward the irradiating direction (the arrow $I_i$) of the ion beam 5, a velocity component toward the direction of the sample 7 can be generated when the electron beam is drawn by the electron drawing electrodes 519 and 559 and when the electron beam is decelerated by the electron energy controlling electrode 132. The advantages similar to those obtained with the foregoing embodiments may also be achieved.

As described above, according to the fourth embodiment, the electron beam emitting source, electron drawing electrode, and electron energy controlling electrode have been arranged in such a manner that the electron beam decelerated by the electron energy controlling electrode has a velocity component directed to the sample side. Therefore, there is an effect such that it is possible to obtain an ion beam irradiating apparatus which can efficiently supply an electron beam into the ion beam and can easily move the electron beam toward the sample.

What is claimed is:

1. An ion beam irradiating apparatus for irradiating a specified neutralized ion beam to a sample, comprising:

generating means for generating ion beams;

accelerating means for accelerating the ion beams produced from the generating means;

selecting means for selecting a specified ion beam from the accelerated ion beams; and ion neutralizer means for neutralizing ions in said specified ion beams, positioned between the selecting means and the sample and including an electron beam emitting source inclined with respect to an irradiation direction of the specified ion beam, for emitting an electron beam, electron drawing means positioned parallel to the electron beam emitting source, for electronically drawing the emitted electron beam from the electron beam emitting source to an orbit of the specified ion beam, said drawn electron beam having a velocity component directed toward the sample, first electron scatter preventing means for preventing the electron beam emitted from the electron beam emitting source from being scattered outside the ion neutralizer means;

second electron scatter preventing means for preventing the electron beam induced into the orbit of the specified ion beam from being scattered in a direction opposite to the ion irradiating direction; and electron energy controlling means for electronically controlling the energy of the electron beam drawn by the electron drawing means into the orbit of the specified ion beam, wherein said electron drawing means an electron incoming plane, positioned parallel to the electron beam emitting source; and an electron outgoing plane, positioned parallel to the electron energy controlling means, which is inclined with respect to said electron incoming plane at a predetermined angle.

2. An ion beam irradiating apparatus for irradiating a specified neutralized ion beam to a sample, comprising:

generating means for generating ion beams;

accelerating means for accelerating the ion beams produced from the generating means;

selecting means for selecting a specified ion beam from the accelerated ion beams; and ion neutralizer means for neutralizing ions in said specified ion beam, positioned between the selecting means and the sample, and including an electron beam emitting source positioned parallel to an irradiation direction of the specified ion beam, for emitting an electron beam, electron drawing means having an electron incoming plane positioned parallel to the electron beam emitting source, and an electron outgoing plane inclined with respect to the electron incoming plane at a first predetermined angle, and an electron energy controlling means inclined with respect to the orbit of the specified ion beam at a second predetermined angle, for electronically controlling the energy of the electron beam drawn by the electron drawing means into the orbit of the specified ion beam, said electron energy controlling means being positioned parallel to said electron outgoing plane of the electron drawing means, and said drawn electron beam having a velocity component directed toward the sample, first electron scatter preventing means for preventing the electron beam emitted from the electron beam emitting source from being scattered outside the ion neutralized means; and second electron scatter preventing means for preventing the electron beam induced into the orbit of the specified ion beam from being scattered in a direction opposite to an ion irradiating direction of the specified ion beam.

3. An ion beam irradiating apparatus as claimed in claim 2, wherein said electron beam emitting means comprises a filament to emit thermoelectrons as said electron beam, said first scattering preventing means comprises a thermoelectron shielding electrode, and said second scattering preventing means comprises a shielding electrode.

4. An ion beam irradiating apparatus as claimed in claim 2, wherein:

said electron drawing means comprises a grating electrode formed and disposed so as to enable the emitted electron beam to pass therethrough.

5. An ion beam irradiating apparatus as claimed in claim 2, wherein said electron energy controlling means comprises:

a grating electrode formed and disposed so as to enable the emitted electron beam to pass therethrough.

* * * * *